US009162099B2

(12) United States Patent
Burkhardt

(10) Patent No.: US 9,162,099 B2
(45) Date of Patent: Oct. 20, 2015

(54) ADDUCTOR AND ABDUCTOR EXERCISE DEVICE

(71) Applicant: Matthew Boyd Burkhardt, East Norwich, NY (US)

(72) Inventor: Matthew Boyd Burkhardt, East Norwich, NY (US)

( * ) Notice: Subject to any disclaimer, the term of this patent is extended or adjusted under 35 U.S.C. 154(b) by 0 days.

(21) Appl. No.: 13/745,305

(22) Filed: Jan. 18, 2013

(65) Prior Publication Data

US 2014/0206512 A1 Jul. 24, 2014

(51) Int. Cl.
*A63B 26/00* (2006.01)
*A63B 21/015* (2006.01)

(52) U.S. Cl.
CPC ..... *A63B 21/015* (2013.01)

(58) Field of Classification Search
USPC ..... 482/142–148
See application file for complete search history.

(56) References Cited

U.S. PATENT DOCUMENTS

| | | | | | |
|---|---|---|---|---|---|
| 2,764,411 | A * | 9/1956 | Washburn, Jr. | ..... | 482/146 |
| 4,601,469 | A * | 7/1986 | Sasser, Jr. | ..... | 482/146 |
| 4,759,542 | A * | 7/1988 | Hudec | ..... | 482/34 |
| 4,911,440 | A * | 3/1990 | Hyman et al. | ..... | 482/146 |
| 5,125,880 | A * | 6/1992 | Peters | ..... | 482/68 |
| 5,152,691 | A * | 10/1992 | Moscarello | ..... | 434/247 |
| 5,399,140 | A * | 3/1995 | Klippel | ..... | 482/146 |
| 5,545,115 | A * | 8/1996 | Corcoran | ..... | 482/146 |
| 5,891,002 | A * | 4/1999 | Maki | ..... | 482/79 |
| 7,374,522 | B2 * | 5/2008 | Arnold | ..... | 482/146 |
| 7,479,097 | B2 * | 1/2009 | Rosborough et al. | ..... | 482/146 |

* cited by examiner

*Primary Examiner* — Glenn Richman

(57) ABSTRACT

An exercise device that enables a user to exercise the adductor and abductor muscles. The exercise device may include a base with at least one base channel and a slant board with at least one slant board channel. The exercise device may further include at least one rolling cylinder configured to fit within the at least one base channel and the at least one slant board channel.

10 Claims, 4 Drawing Sheets

ADDUCTOR AND ABDUCTOR EXERCISE DEVICE

BACKGROUND OF THE INVENTION

The present invention relates to an exercise device and, more particularly, to an exercise device that exercises both adductor and abductor muscles.

Currently, exercise machines generally fail to enable users to exercise both the adductor and abductor muscles. In order to exercise both adductor and abductor, a user may have to use two separate machines. However, some machines that do allow a user to exercise the adductor and abductor muscles are extremely expensive.

As can be seen, there is a need for a less expensive machine that exercises the adductor and abductor muscles.

SUMMARY OF THE INVENTION

In one aspect of the present invention, an exercise device comprises: a base comprising at least one base channel having a front end and a rear end, wherein said channel comprises at least one forward rolling cylinder stop near the front end and at least one rear rolling cylinder stop near the rear end; at least one slant board located above the base comprising at least one slant board channel located above the at least one first channel; a seat support attached near the rear of the slant board comprising a seat; and at least one rolling cylinder configured to fit within the at least one base channel and the at least one slant board channel.

In another aspect of the present invention, said base comprises two base channels and said at least one slant board comprises two slant board channels.

In another aspect of the present invention, the device further comprises an overhead handle bar attached to said exercise device.

In another aspect of the present invention, the device further comprises an anchor bar protruding from the rear of the base and pivotally attached to said overhead handle bars.

In another aspect of the present invention, the device further comprises a connecting bar connected to the rear of the slant board by a pivot bracket and connected to the overhead handle bars in front of the anchor bar.

In another aspect of the present invention, the device further comprises at least one handle bar attached to said seat support.

In another aspect of the present invention, the device further comprises a support connected to said base.

In another aspect of the present invention, the device further comprises a footpad pivotally attached to the front end of said slant board.

In another aspect of the present invention, the device further comprises at least one foot strap attached to said footpad.

In another aspect of the present invention, the device further comprises a plurality of rollers connected to the base and the at least one rolling cylinder, wherein a cord runs along the plurality of rollers.

These and other features, aspects and advantages of the present invention will become better understood with reference to the following drawings, description and claims.

DETAILED DESCRIPTION OF THE INVENTION

Figure 1:
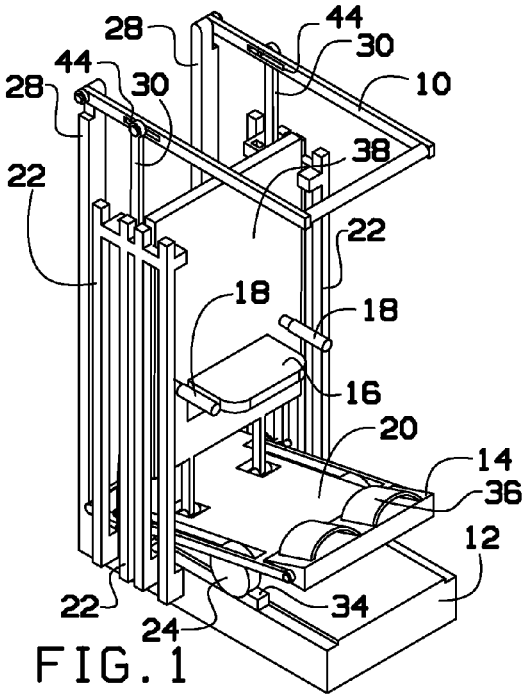
FIG. 1 is a forward perspective view of the invention shown with item 14 footpad in up position.

The following detailed description is of the best currently contemplated modes of carrying out exemplary embodiments of the invention. The description is not to be taken in a limiting sense, but is made merely for the purpose of illustrating the general principles of the invention.

Broadly, an embodiment of the present invention provides an exercise device that enables a user to exercise the adductor and abductor muscles. The exercise device may include a base with at least one base channel and a slant board with at least one slant board channel. The exercise device may further include at least one rolling cylinder configured to fit within the at least one base channel and the at least one slant board channel.

Referring to FIGS. 1 through 12, the present invention may include an exercise machine with a base 12. The base 12 may include at least one channel. For example, the base 12 may include two channels on each outer edge. At the front of the base channel there may be at least one forward rolling cylinder stop 32. At the rear of the base channel there may be at least one rear rolling cylinder stop 34. Protruding from the rear of the base 12 may be an anchor bar 28. The anchor bar 28 may be substantially perpendicular to the base 12. An overhead handle bar 10 may be pivotally connected to the top of the anchor bar 28.

Figure 5:
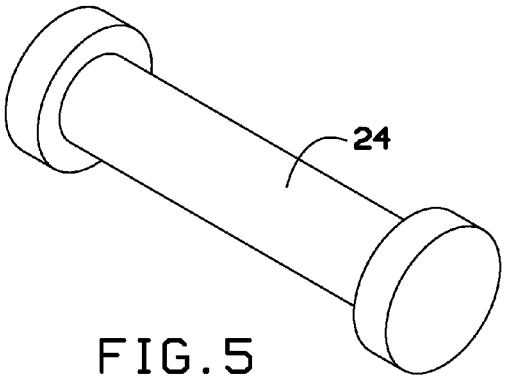
FIG. 5 is a perspective view of item 24 rolling cylinder only.
Figure 6:
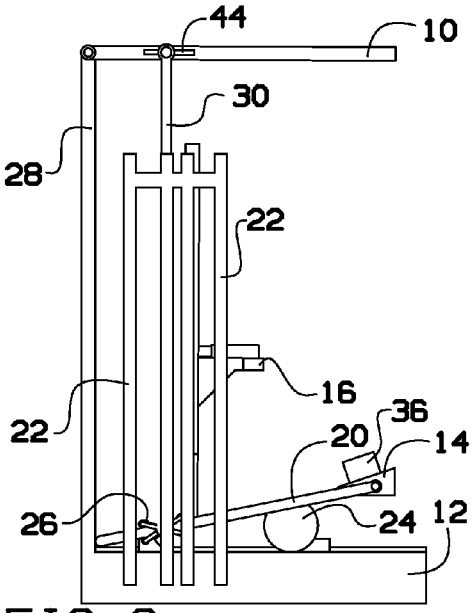
FIG. 6 is a side view of the invention shown with item 14 footpad in up position.
Figure 7:
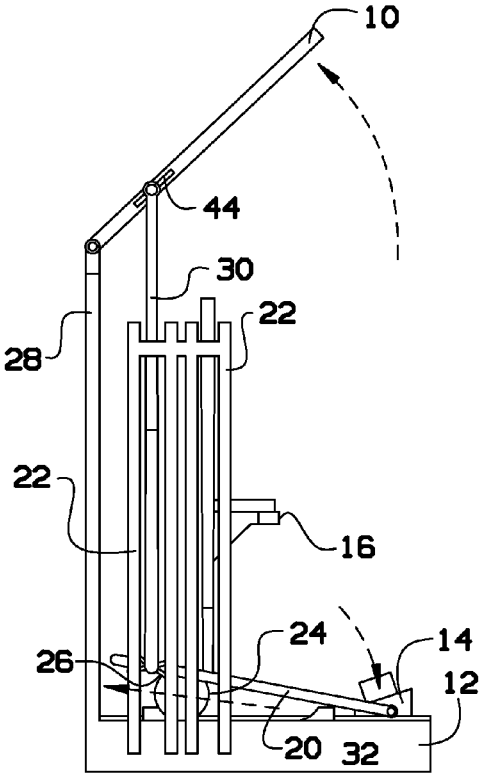
FIG. 7 is a side view of the invention shown with item 14 footpad in down position.
Figure 8:
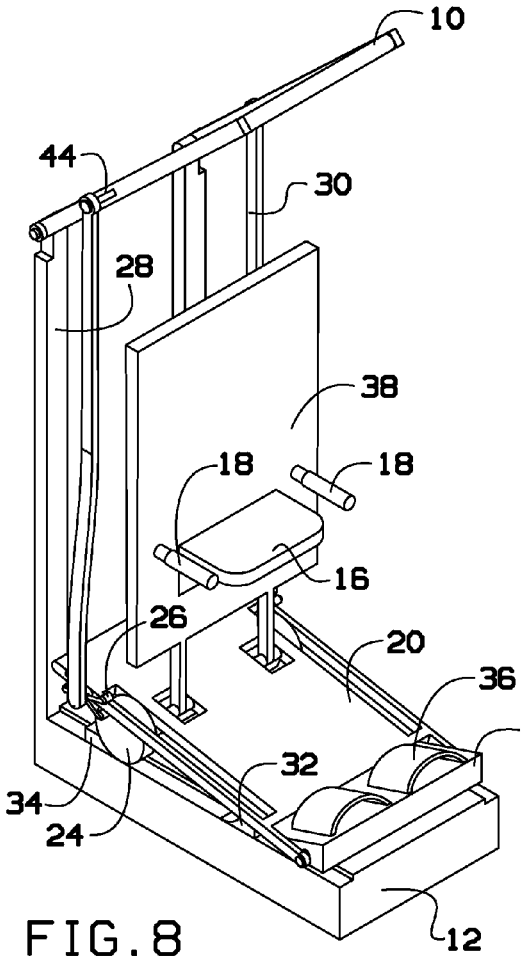
FIG. 8 is a forward perspective view of the invention shown with item 14 footpad in down position and omitting item 22 support frame for illustrative clarity.
Figure 9:
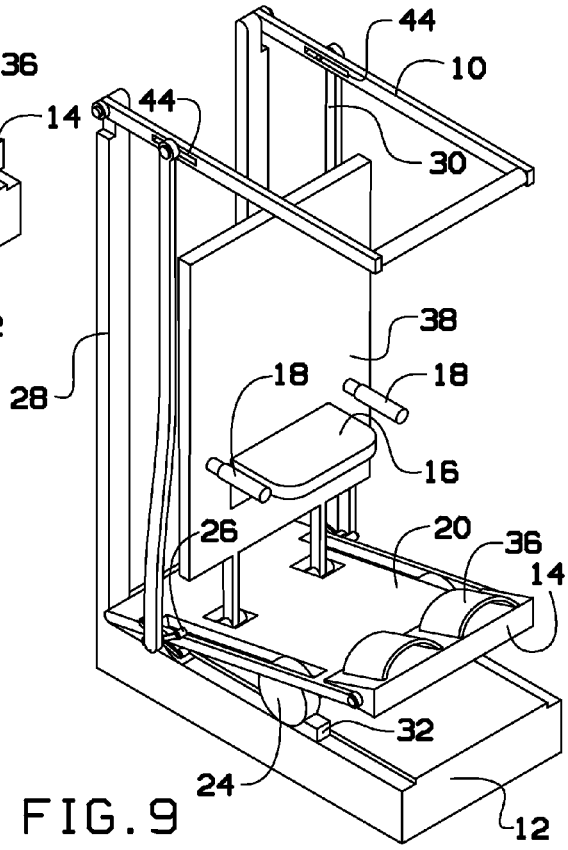
FIG. 9 is a forward perspective view of the invention shown with item 14 footpad in up position and omitting item 22 support frame for illustrative clarity.
Figure 10:
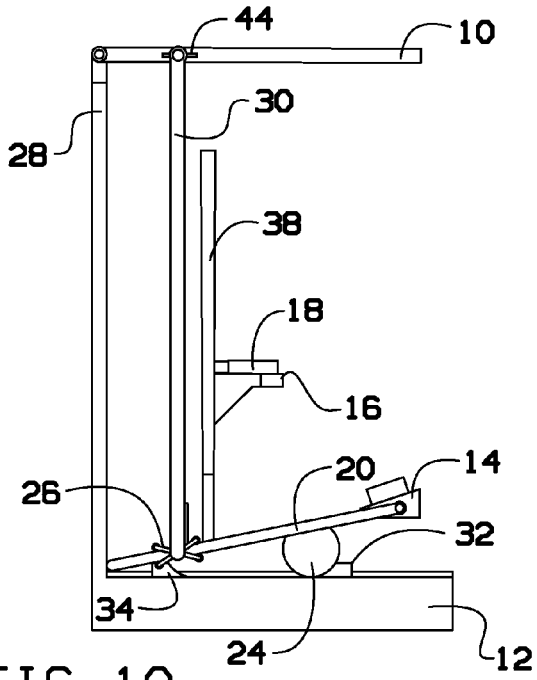
FIG. 10 is a side view of the invention shown with item 14 footpad in up position and omitting item 22 support frame for illustrative clarity.
Figure 11:
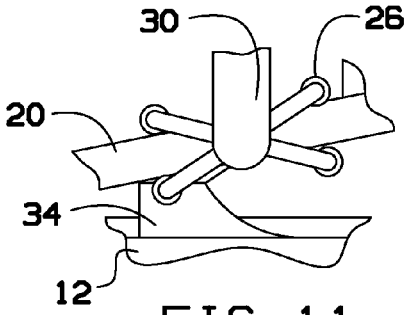
FIG. 11 is a detail side view of the invention.

At least one rolling cylinder 24 may rest within the channels. The rolling cylinder may rotate within the channels and in between the forward rolling cylinder stop 32 and the rear rolling cylinder stop 34. As illustrated in FIG. 5, the rolling cylinder 24 may include a bar with two discs on either side. However, the rolling cylinder 24 may be configured to have substantially the same circumference across the entire device. In certain embodiments, the rotating cylinder 24 may comprise multiple discs. As disclosed, the rolling cylinder 24 may be in multiple configurations to provide a similar function.

The present invention may further include a slant board 20. The slant board 20 may be located above the base 12. The slant board 12 may include at least one slant board channel corresponding with the at least one base channel. The rolling cylinder 24 may rest within the channel of the slant board 20 and the corresponding channel of the base 12. In certain embodiments, a footpad 14 may be at the front end of the slant board 20. In certain embodiments, the footpad 14 may connect to the slant board 20 by a rotating hinge and thereby the footpad 14 may pivot with respect to the slant board 20. The slant board may be in a planar or a non-planar shape such as a concave/convex fashion.

In certain embodiments, a seat support 38 may be connected to the exercise device. For example, as illustrated in the Figures, the seat support 38 may be connected to the rear of slant board 20. However, the seat support 38 may be in a different configuration to serve a similar purpose. For example, a flange running the length of the slant board 20 and projecting perpendicular up from the slant board 20 may connect with the seat support 38. The seat support 38 may include a seat 16 and at least one handle 18. However, the handle 18 may be located and attached directly to the slant board 20, and thereby be in front of a user. Behind the seat support 38 and attached to the slant board 20 may be a connecting bar 30. The connecting bar 30 may be adjacent to the rear rolling cylinder stop 34. The connecting bat 30 may be connected to the slant board 20 by a pivot bracket 26. In certain embodiments, the connecting bar 30 may protrude upwards. The connecting bar 30 may connect to the overhead handle bars 10 near the top by a vertical bar connection slot 44.

In certain embodiments, the present invention may further include a support frame 22. The support frame 22 may support the exercise device. For example, as illustrated, the support frame 22 may connect to the base 12 and run vertically up the exercise machine. The support frame 22 may further connect to other components of the exercise machine to further provide support and stability.

Figure 2:
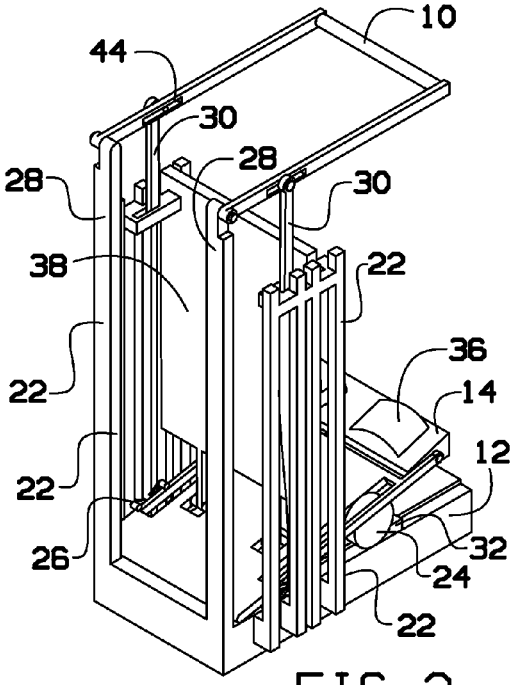
FIG. 2 is a rear perspective view of the invention shown with item 14 footpad in up position.
Figure 3:
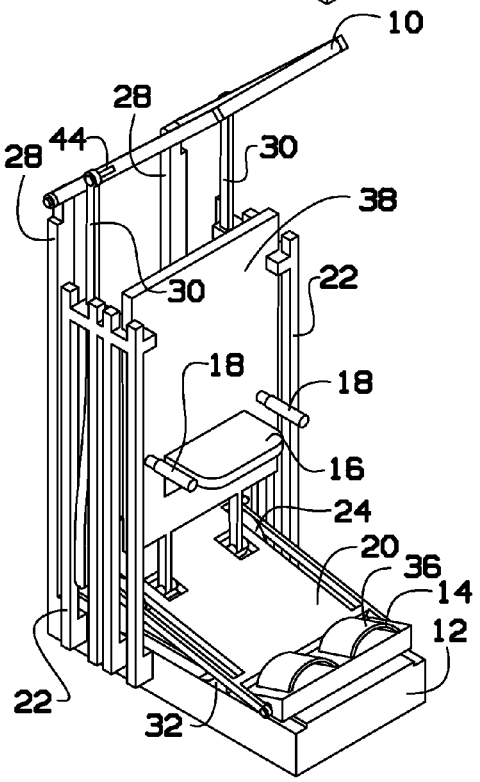
FIG. 3 is a forward perspective view of the invention shown with item 14 footpad in down position.
Figure 4:
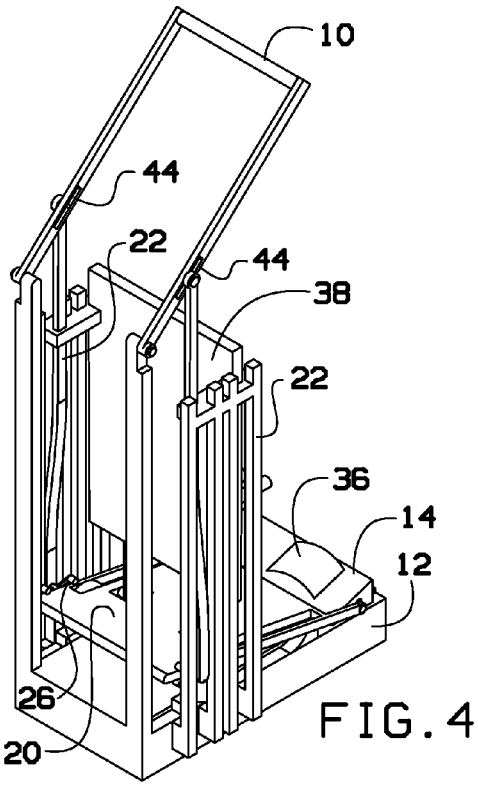
FIG. 4 is a rear perspective view of the invention shown with item 14 footpad in down position.

To use the invention, the user may sit on the seat 16 supported by the seat support 38 that rests on the slant board 20. The user may secure his feet to the foot pad 14 using the foot strap 36. When the rolling cylinder 24 is near the front of the base, resting against the forward rolling cylinder stop 32, the slant board 20 may be slanting upward, as illustrated in FIGS. 1 and 2. The user may press the front of the slant board 20 with his feet. This may thereby force the rolling cylinder 24 to rotate towards the seat support 38. At this point, the slant board 20 may be slanting downwards, as illustrated in FIG. 3. Once pushed all the way, the rolling cylinder 24 may be pressed against the rear rolling cylinder stop 34.

In certain embodiments, the user may lift the front of the slant board 20 using the foot straps 36. The user may lift the slant board 20 when the rolling cylinder is pressed against the rear rolling cylinder stop 34. The momentum produced by the user's body weight and foot motion may force the cylinder to roll back to the front of the machine, and up to the forward rolling cylinder stop 32. Again, in this position, the slant board 20 may be slanting upward.

The overhead handle bar 10 may also be used as a mechanism to move the rolling cylinder 24 from the forward rolling cylinder stop 32 to the rear rolling cylinder stop 34 and vice versa. For example, the overhead handle bar 10 may be pushed upward, thereby lifting the rear of the slant board 20 and positioning the slant board 20 towards the downward slanting position. Further, the overhead handle bar 10 may pulled downward, pushing the rear of the slant board 20 and positioning the slant board 20 towards the upward slanting position.

Figure 13:
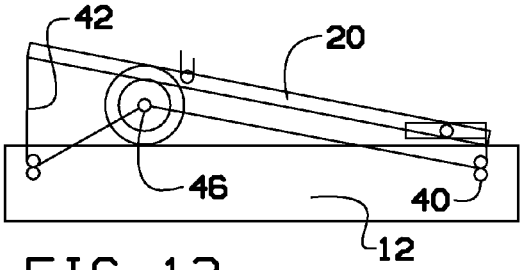
FIG. 13 is a schematic view of an alternate embodiment of the invention.
Figure 14:
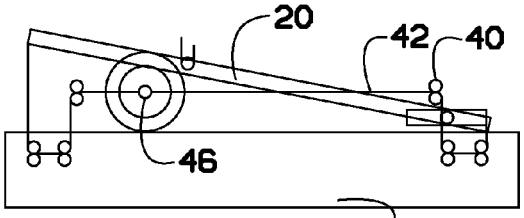
FIG. 14 is a schematic view of an alternate embodiment of the invention.
Figure 12:
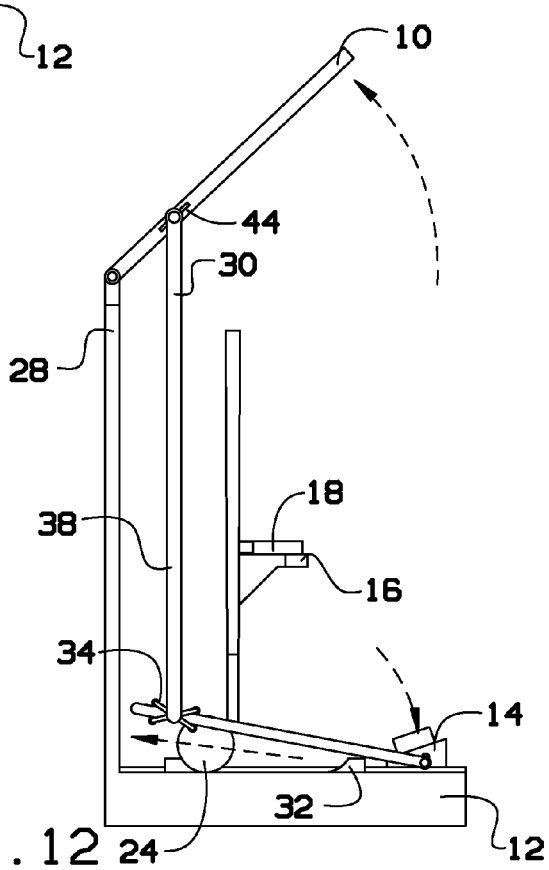
FIG. 12 is a side view of the invention shown with item 14 footpad in down position and omitting item 22 support frame for illustrative clarity.

As illustrated in FIGS. 13 and 14, the present invention may further include a plurality of rollers 40 and a cord 42. The plurality of rollers 40 may be mounted on the base 12. A roller 40 may further be mounted onto the rolling cylinder 24. The rollers 40 may act as a track for the cord 42 to run along. In such embodiments, the cord 42 and rollers 40 may be used to aid in moving the rolling cylinder 24 back and forth along the channels It should be understood, of course, that the foregoing relates to exemplary embodiments of the invention and that modifications may be made without departing from the spirit and scope of the invention as set forth in the following claims.

What is claimed is:

1. An exercise device comprising:

a base comprising at least one base channel having a front end and a rear end, wherein said base channel comprises at least one forward rolling cylinder stop near the front end and at least one rear rolling cylinder stop near the rear end;

at least one slant board located above the base comprising at least one slant board channel located above the at least one first channel;

a seat support attached to the exercise device comprising a seat; and at least one rolling cylinder configured to fit within the at least one base channel and the at least one slant board channel.

2. The exercise device of claim 1, wherein said base comprises two base channels and said at least one slant board comprises two slant board channels.

3. The exercise device of claim 1, further comprising an overhead handle bar attached to said exercise device.

4. The exercise device of claim 3, further comprising an anchor bar protruding from the rear of the base and pivotally attached to said overhead handle bars.

5. The exercise device of claim 3 further comprising a connecting bar connected to the rear of the slant board by a pivot bracket and connected to the overhead handle bars in front of the anchor bar.

6. The exercise device of claim 1, further comprising at least one handle bar attached to said seat support.

7. The exercise device of claim 1, further comprising a support connected to said base.

8. The exercise device of claim 1, further comprising a footpad pivotally attached to the front end of said slant board.

9. The exercise device of claim 1, further comprising at least one foot strap attached to said footpad.

10. The exercise device of claim 1, further comprising a plurality of rollers connected to the base and the at least one rolling cylinder, wherein a cord runs along the plurality of rollers.

* * * * *